United States Patent [19]

Auten

[11] 4,291,086

[45] Sep. 22, 1981

[54] COATING SYSTEM FOR ROOFS, SWIMMING POOLS AND THE LIKE

[76] Inventor: Jerry P. Auten, Rte. 6, Box 752, Charlotte, N.C. 28204

[21] Appl. No.: 168,419

[22] Filed: Jul. 10, 1980

Related U.S. Application Data

[63] Continuation-in-part of Ser. No. 39,805, May 17, 1979, Pat. No. 4,212,913.

[51] Int. Cl.[3] ..... B32B 7/00; B32B 17/04; E04D 5/10

[52] U.S. Cl. ..... 428/242; 428/257; 428/258; 428/268; 428/273; 428/441; 428/484; 428/229; 428/251

[58] Field of Search ..... 428/245, 246, 247, 251, 428/257, 258, 259, 268, 273, 441, 489, 242, 229

[56] References Cited

U.S. PATENT DOCUMENTS

| | | | |
|---|---|---|---|
| 4,007,311 | 2/1977 | Harlan | 428/251 |
| 4,082,882 | 4/1978 | Weinstein | 428/251 |
| 4,212,913 | 7/1980 | Auten | 428/258 |
| 4,219,603 | 8/1980 | Thim | 428/489 |

*Primary Examiner*—James J. Bell

*Attorney, Agent, or Firm*—Richards, Shefte & Pinckney

[57] ABSTRACT

A coating system of high tensile strength and resilience for use as a coating for roofs, swimming pools or the like having an underlayer of coating material, an intermediate layer of woven fiber glass fabric that includes strands of bulked yarn in a relatively loose weave, and an overlayer of coating material, with the fiber glass fabric being embedded in the coating system between the underlayer and overlayer. Alternatively the underlayer may be of asphalt material and the overlayer may be a first overlayer bonded to the underlayer with the intermediate layer embedded therebetween and a second overlayer bonded to the first overlayer. The coating material contains water, a high solids thermoplastic acrylic emulsion, calcium carbonate, titanium dioxide, sodium salt of polymeric carboxylic acid, a wetting, emulsifying and stabilizing agent and defoamers, with zinc oxide being used if desired for mildew resistance.

12 Claims, 8 Drawing Figures

FIG. 1
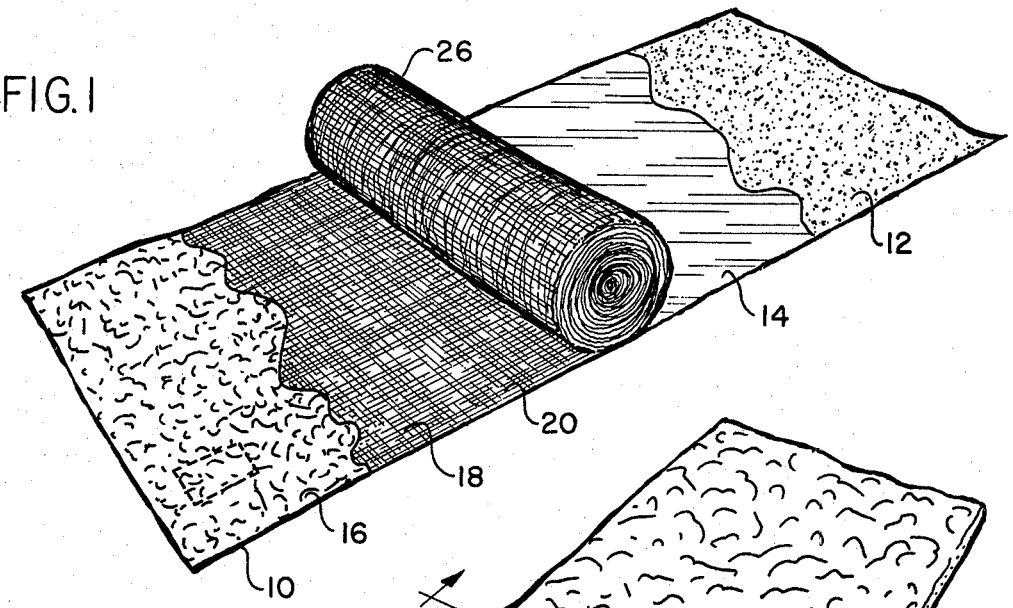
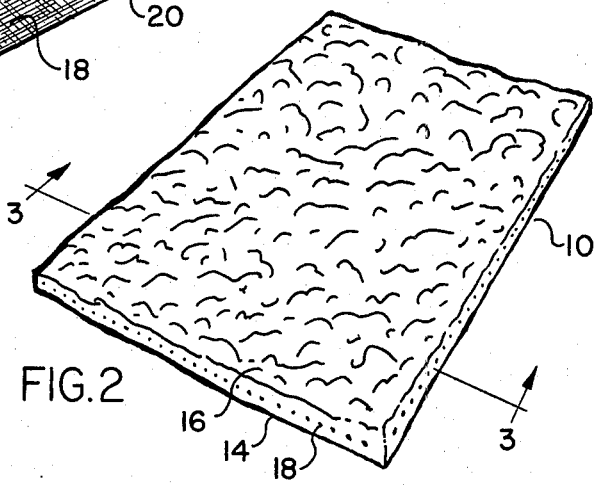
FIG. 2
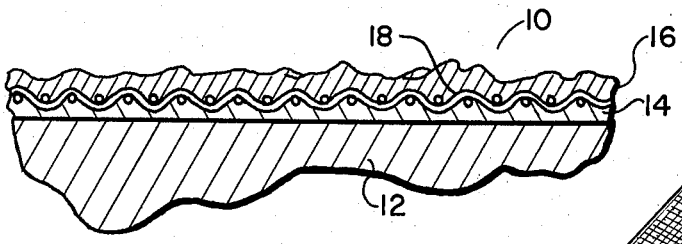
FIG. 3
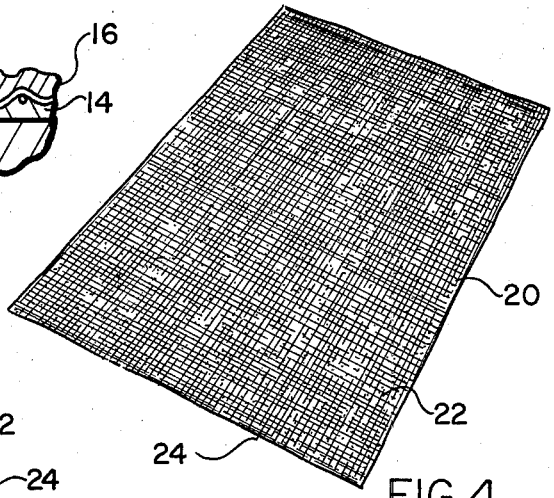
FIG. 4
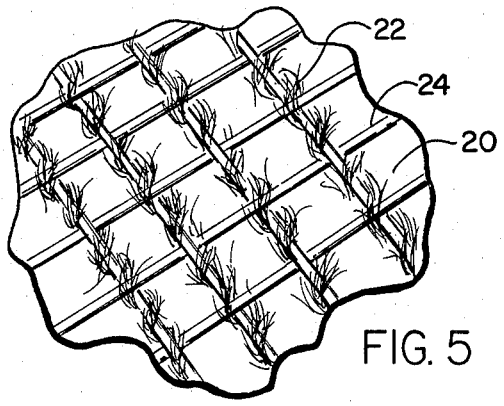
FIG. 5

FIG. 6
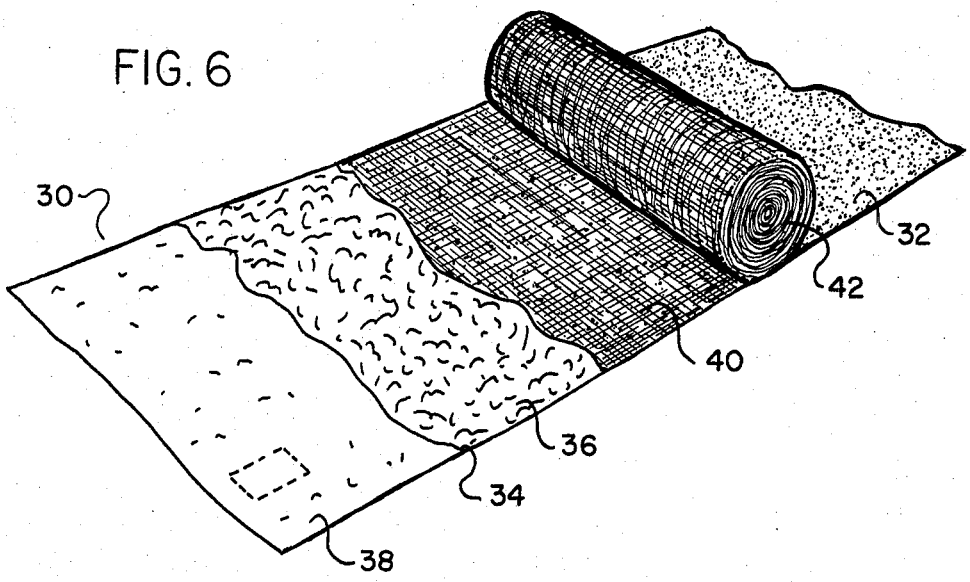
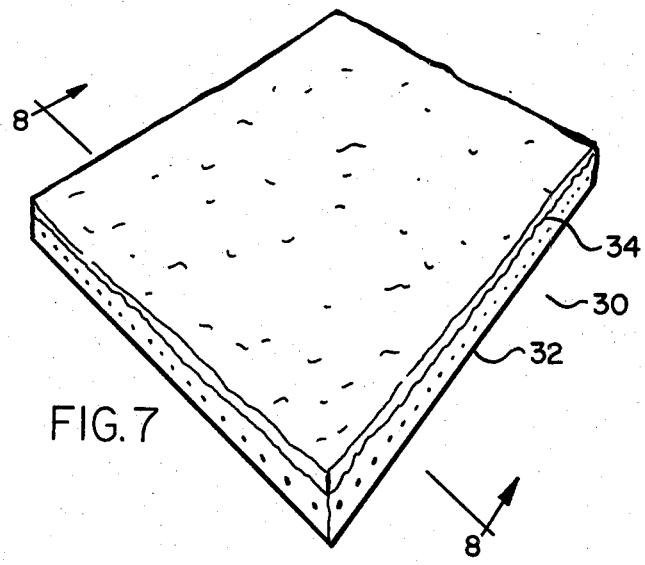
FIG. 7
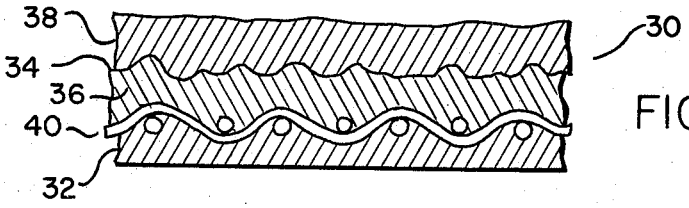
FIG. 8

COATING SYSTEM FOR ROOFS, SWIMMING POOLS AND THE LIKE

CROSS-REFERENCE TO RELATED APPLICATION

This application is a continuation-in-part of my copending U.S. Patent Application Ser. No. 039,805, filed May 17, 1979, for Roof Coating System, which issued July 15, 1980, as U.S. Pat. No. 4,212,913.

BACKGROUND OF THE INVENTION

The present invention relates to a coating system for roofs, swimming pools and the like and more particularly to such a coating system having reinforcement material embedded therein, which in combination with the coating material of the system provides high tensile strength and resilience such as to effectively minimize subsequent splitting, "alligatoring", wrinkling and blistering, and provide stable cover of pre-existing splits, "alligatoring", wrinkling and blistering.

As used here, the term "alligatoring" means localized cracks developed from repeated contraction and expansion due to weather conditions and the drying of asphaltic and coal tar.

Numerous coating systems for roofs, swimming pools and the like have been developed over the years in an attempt to obtain the best combination of results. Various compositions have been used, including acrylic emulsions and various filler and reinforcing material has been used, including fiber glass fibers to provide strength and resilience. Such fiber glass fibers have been used in acrylic emulsions for reinforcement and resilience. Also, bulked fiber glass sheets have been used for similar purposes in cementitious compositions for roof coating systems. Further, conventional non-bulked fiber glass yarn in woven sheets have been used in acrylic emulsions.

These various coating system combinations have provided varying degrees of coverage and protection against splitting, "alligatoring", wrinkling and blistering and in covering old systems having these problems, but none of them has proven fully satisfactory to the extent necessary for desired results. Heretofore, best results have been obtained using an acrylic emulsion with conventional woven non-bulked fiber glass in a particular acrylic emulsion composition, which has been satisfactory in covering level uniform new surfaces, but has not been satisfactory for recovering non-uniform surfaces.

In contrast, the present invention provides excellent protection without subsequent development of splits, "alligatoring", wrinkling or blistering, and particularly provides stable long-lasting coverage of existing defects on pre-existing surfaces such that the system is universally applicable to new surfaces and recovering of existing systems without notable disadvantages, particularly avoiding splitting, "alligatoring", wrinkling and blistering and short wear life.

SUMMARY OF THE INVENTION

Basically described, the present invention provides a coating system of high tensile strength and resilience and comprises an underlayer of either coating material or asphalt material, an intermediate layer of woven fiber glass fabric, and an overlayer of coating material bonded to the underlayer with the intermediate fiber glass fabric layer embedded between the underlayer and the overlayer. Where the system utilizes asphalt material as the underlayer, the overlayer comprises first and second overlayers bonded together and with the first overlayer bonded to the underlayer with the intermediate fiber glass fabric layers embedded between the underlayer and the first overlayer. The woven fiber glass fabric includes strands of bulked yarn in a relatively loose weave. The coated material is an acrylic resin emulsion.

Preferably, the intermediate layer of woven fiber glass fabric has strands of bulked yarn as the filling ends of the fabric and strands of non-bulked yarn as the warp ends of the fabric. Also, preferably, the coating material includes water, a high solids thermoplastic acrylic emulsion, calcium carbonate, titanium dioxide, sodium salt of polymeric carboxylic acid, a wetting, emulsifying and stabilizing agent and defoamers.

In the preferred embodiment, the woven fiber glass fabric has a weight of approximately four ounces per square inch with approximately eighteen warp ends per inch and fifteen filling ends per inch, both warp and filling ends being one hundred fifty denier single yarn with a twist of approximately 0.7 turns per inch. Also, in the preferred embodiment, the coating material components are combined in relative approximate quantities of seventy gallons of water, fifty-five gallons of high solids thermoplastic acrylic emulsion, five hundred pounds of calcium carbonate, fifty pounds of titanium dioxide, 4.8 pounds of sodium salt of polymeric carboxylic acid, 1.4 pounds of octyl phenol polyethoxy ethanol and one gallon defoamers.

If desired for quicker setting in cooler spring and fall months particularly, the water content can be reduced by approximately 25% to 30%. The composition can also be varied by adding zinc oxide for mildew resistance.

BRIEF DESCRIPTION OF THE DRAWINGS

FIG. 1 is a perspective view of the sequence of producing the coating system of one form of the present invention in a manner showing the underlayer, intermediate layer and overlayer of the system as it is applied to an existing surface;

FIG. 2 is an enlarged perspective view of a portion of the completed part of the coating system of FIG. 1 as marked by the rectangle in FIG. 1;

FIG. 3 is an enlarged vertical section of the coating system of FIG. 1 as taken along line 3—3 of FIG. 2;

FIG. 4 is an enlarged perspective view of the bulked woven fiber glass fabric of the intermediate layer of the coating system of FIG. 1;

FIG. 5 is an enlarged perspective view of the fabric of FIG. 4 showing the woven yarn construction in detail;

FIG. 6 is a perspective view of the sequence of producing the coating system of another form of the present invention in a manner showing the underlayer, intermediate layer and overlayer of the system as it is applied to an existing surface;

FIG. 7 is an enlarged perspective view of a portion of the completed part of the coating system of FIG. 6 as marked by the rectangle in FIG. 6; and FIG. 8 is an enlarged verticle section of the coating system of FIG. 6 as taken along line 8—8 of FIG. 7.

DETAILED DESCRIPTION OF THE PREFERRED EMBODIMENTS

Referring to the drawings, the coating system 10 of one form of the present invention is illustrated in FIGS. 1–5, FIG. 2 being an illustration of a portion of a coating system as applied to a roof 12, and FIG. 3 being a cross-section of the system 10 of FIG. 2.

This coating system 10 includes an underlayer 14 of coating material of acrylic resin emulsion that is bonded to the surface of the roof 12. An overlayer 16 of the same coating material as the underlayer 14 is located on top and bonded to the underlayer 14. Disposed in the bond between the underlayer 14 and the overlayer 16 is an intermediate layer 18 of woven fiber glass fabric 20.

The acrylic resin emulsion of the coating material of the underlayer 14 and overlayer 16 provides better strength in resistance to the aforementioned conventional defects than other generally known prior coating materials, but is still susceptible when used by itself to possible splitting, "alligatoring", wrinkling and blistering with age, particularly after considerable temperature fluctuations. However, the woven fiber glass fabric 20 of the intermediate layer 18 enhances substantially the tensile strength and resilience of the overall roof coating system 10 to provide substantially improved resistance to splitting, "alligatoring", wrinkling and blistering under normal weather and wear conditions such that this new system provides results generally free of the short term results of weather and wear occasioned with the use of the mentioned prior art systems.

This enhanced tensile strength and resilience in the combined coating material and fiber glass fabric system of the present invention is obtained by using a woven fiber glass fabric in which strands of conventional bulked fiber glass yarn 22 are woven in a relatively loose weave. In the preferred embodiment of the present invention, the filling ends of the woven fabric are made with the strands of bulked yarn 22 and the warp ends are made of non-bulked fiber glass yarn 24. Both of the yarns 22 and 24 are 150 denier single end yarn with a twist of approximately 0.7 turns per inch woven with approximately 18 warp ends per inch and approximately 15 filling ends per inch, and resulting in a fabric weight of approximately four ounces per square inch.

The particular construction of the woven fiber glass fabric 20 provides a looseness of weave sufficient for strong bonding of the underlayer 14 to the overlayer 16 with the intermediate layer 18 embedded therein and the bulked characteristic of the yarn 22 enhances the bonding of the fabric 20 in the system 10. With this bulked fiber glass yarn fabric and the embedded arrangement, sufficient tensile strength and resilience are provided in a combination that resists undue localized stress that produces the aforementioned conventional defects. Rather, the tendency towards localized stress is dissipated and resisted by the fabric and emulsion combination.

The coating material of the underlayer 14 and overlayer 16 that provides the results attributable to the present invention includes water, high solids thermoplastic acrylic emulsion, calcium carbonate, titanium dioxide, sodium salt of polymeric carboxylic acid, a wetting, emulsifying and stabilizing agent, and defoamers.

In the preferred embodiment of the present invention the wetting, emulsifying and stabilizing agent is octyl phenol polyethoxy ethanol and the components of the coating material are included in the following approximate percentages by weight:

| | |
|---|---|
| Water | 36.0% |
| High Solids Thermoplastic acrylic emulsion | 29.0% |
| Calcium carbonate | 31.0% |
| Titanium dioxide | 3.0% |
| Sodium salt of polymeric carboxylic acid | 0.3% |
| Octyl phenol polyethoxy ethanol | 0.1% |
| Defoamers | 0.5% |

The water acts as a carrier for all of the other ingredients and is evaporated out of the material upon drying.

The high solids thermoplastic acrylic emulsion serves as a binder for all the other ingredients and bonds the layers of the system together and to the roof. In the preferred embodiment this component is Rhoplex LC-67 sold by Rohm and Haas Company of Philadelphia, Pennsylvania, which is conventionally sold for the formulation of pressure-sensitive and laminating adhesives.

The calcium carbonate serves as a filler to build up the total solids of the coating material and to reduce the surface tack of the aforementioned acrylic emulsion. It is primarily inert in the completed system.

The titanium dioxide is a pigment that functions to give whiteness and brightness to the coating and also provides hiding or covering power.

The sodium salt of polymeric carboxylic acid serves to disburse the titanium dioxide pigment in the coating material. Preferably Tamol 850 sold by Rohm and Haas Company is used for this component. Tamol 850 is a clear aqueous solution of a very low-foaming light-colored dispersant which is conventionally useful in maintaining low viscosity, both in high-solids clay slurries and in clay coating.

The octyl phenol polyethoxy ethanol component serves as a pigment wetting agent, emulsifier and stabilizing agent for the coating material. Preferably Triton X405 sold by Rohm and Haas Company is used for this component.

The defoamers may be any conventional defoamers compatible with the other components of the coating material. In the preferred embodiment, the conventional defoamer used is Nopco NXZ sold by Nopco Chemical Company of Charlotte, N.C.

In addition to the above components, zinc oxide may be added to provide resistance to mold and mildew. Of course, the amount of this component may be varied or omitted as desired for particular results. In hot humid climates as much as 3% to 5% by weight of zinc oxide may be used. In less hot and humid climates half this amount may be all that is preferred, and in some climates no zinc oxide at all may be desired.

Also, the amount of calcium carbonate may be varied. When the amount of calcium carbonate is increased, the surface tack of the system is decreased, the coating thickness increased, dirt collection on the material surface decreased and water evaporation and drying increased for a faster set. Decreasing the amount of calcium carbonate would obviously have the reverse effects.

The water content is preferably reduced in cool humid weather, such as in spring and fall, to facilitate proper drying without a prolonged drying period. Preferably this reduction of water content is in the range of 25 to 30% of the amount mentioned hereinabove, but a lesser decrease or no decrease can be used to suit particular weather conditions. In this regard, sufficient water content is necessary to avoid too fast drying that could prevent proper lamination of the fiber glass fabric in the underlayer.

The roof coating system 10 of FIGS. 1–5 is applied to a roof 12 by first applying the underlayer of coating material by spray, brush or roller and while this is being done immediately following up with the laying of the intermediate layer 18 of fiber glass fabric by unrolling from a roll 26 (see FIG. 1). The fiber glass fabric 20 is then gently brushed with a broom into the wet underlayer 14. The coating material of the overlayer 16 is then applied in the same manner as the underlayer 14 immediately following the application of the fabric 20. On hot dry days the overlayer 16 may be applied as soon as the fiber glass fabric 20 has been applied, but on cool humid days a time interval may be necessary, sometimes as much as a full day. Preferably the overlayer 16 is applied in two coats, with the second coat following the first coat immediately after completion of the first coat application to the roof, but in cool humid weather the second coat can be delayed for hours or a day or even longer to suit weather conditions or for convenience.

Typical examples of the formulation and application of the form of the invention of FIGS. 1–5 are as follows:

EXAMPLE I

A batch of coating material is prepared from the following components in the indicated relative approximate quantities:

| | |
|---|---|
| Water | 70 Gallons |
| High solids thermoplastic acrylic emulsion (Rhoplex LC-67) | 55 Gallons |
| Calcium carbonate | 500 Pounds |
| Titanium dioxide | 50 Pounds |
| Sodium salt of polymeric carboxylic acid (Tamol 850) | 4.8 Pounds |
| Octyl phenol polyethoxy ethanol (Triton X-405) | 1.4 Pounds |
| Defoamers (Nopco NXZ) | 1 Gallon |

This coating material is sprayed on a roof surface in an amount of approximately five gallons per 100 square feet. As the spraying of the underlayer continues, the fiber glass fabric 20 of the preferred embodiment described above is unrolled from a roll 26 onto the underlayer 14 and it is gently brushed with a broom to force it into the still wet underlayer. In warm dry weather the coating material is then sprayed on top of the underlayer 14 and fabric 20 to form the first coat of the overlayer 16 and a second coat is then applied after the spraying of the first coat has been completed.

EXAMPLE II

The coating material of Example I is prepared adding 75 pounds of zinc oxide for use in a humid climate where mildew resistance is important. The application procedure described in Example I is followed except that a full day drying time is allowed between application of the first and second coats of the overlayer 16.

EXAMPLE III

The coating material of Example I is prepared, with the exception that 50 gallons of water are used instead of 70 gallons. This coating material is intended for application in cooler drier weather, such as in northern climates or in spring and fall in southern climates. It is applied in the same manner as described in Example I with a one day delay between application of the two coats of the overlayer 16.

The form of the present invention illustrated in FIGS. 1–5 and described in detail hereinabove in relation to a roof coating system is illustrated, described and claimed in the aforementioned copending U.S. Patent Application Ser. No. 039,805, now U.S. Pat. No. 4,212,913. This invention is applicable as well to coating systems for swimming pools and other surfaces of like nature wherein the prior art disadvantages described above exist and wherein the advantages of the present invention as defined above will produce enhanced results. The present continuation-in-part application discloses the applicability of the disclosure of the parent application to surfaces other than roofs and particularly to swimming pools and similar surfaces having related surface integrity problems or where waterproofing is desired, such as for waterproofing below grade or above grade masonry or the like.

The present application also, in addition to including the disclosure from the aforementioned copending application, adds a disclosure of a variation of the invention as illustrated in FIGS. 6–8 and described in detail herein below.

In the form of the invention illustrated in FIGS. 6–8, a coating system 30 is illustrated for use on a roof, swimming pool or any other appropriate surface. This coating system 30 is similar to the coating system of the form of the invention of FIGS. 1–5 in that it utilizes the same coating material composition and fiber glass fabric sheet material, but differs in that the underlayer 32 is of asphalt material and the overlayer 34 is formed as a first overlayer 36 and a second overlayer 38 with the intermediate fiber glass fabric layer 40 being embedded between the underlayer 32 of asphalt material and the first overlayer 36 of coating material. This system is preferably used on existing roofs and other surfaces where a coating of asphalt material would be applied first to cover existing cracks and weathering defects prior to application of the coating system.

The coating system 30 of FIGS. 6–8 is applied by first spreading an underlayer 32 of asphalt material on the surface to be coated. This asphalt material may be cold emulsified asphalt, cold solvent base asphalt or a hot asphalt. Typical examples of suitable asphalt material are Koppers 480, Tennessee Coatings-FGS50 or Tennessee Coatings emulsified asphalt.

While the asphalt is still wet or soft, the fiber glass fabric layer 40 is unrolled from a roll 42 onto the asphalt underlayer 32 and impressed therein by brushing with a broom or the like. Preferably, the seams where the strips of the fiber glass fabric abut are covered by another application of the asphalt material. The first overlayer 36 of coating material is then applied over the intermediate fiber glass fabric layer 40, and as the fiber glass fabric is porous, the coating material of the first overlayer will pass through the fabric into bonding contact with the asphalt underlayer 32 such that the intermediate fiber glass fabric layer 40 will be embedded between the underlayer 32 and the first overlayer 36. The first overlayer 36 is then allowed to dry, which usually is overnight, but in warm, dry weather where the temperature is, for example, 70° F. and the relative humidity is in the range of 40%, sufficient drying may take place in about three hours. After the first overlayer 36 has dried sufficiently, a second overlayer 38 of the coating material is applied over the first overlayer 36 and bonds thereto to complete the roof system 30.

This form of the present invention illustrated in FIGS. 6–8 permits substantially reduced application time as compared with the form of FIGS. 1–5 as the first layer of coating material is the first overlayer 36, which is on top of the fiber glass fabric layer 40 and, thereby, fully exposed for drying, whereas in the form of the invention in FIGS. 1–5 the fiber glass fabric layer is over the underlayer of coating material and, thereby, restricts exposure for drying. In both forms approximately the same amount of coating material is used in total so that the high tensile strength and resilience of the coating material in combination with the fiber glass fabric will be approximately the same in both forms. On new roofs where the basic roofing material has already been applied and dried and there is no need to apply an asphalt covering layer over defects as there is on an old roof, the form of the invention of FIGS. 1–5 is preferably used. Further, in some instances of low temperature and high humidity extended periods of drying may be necessary, and the drying time between applicaton of the first layer of coating material and the second layer of coating material may be as much as thirty days.

Typical examples of the application of the form of the invention of FIGS. 6–8 are as follows:

EXAMPLE IV

An underlayer of asphalt material is applied to an old roof surface sufficient to provide a complete covering layer. This is immediately followed by unrolling the layer of fiber glass fabric onto the asphalt layer and gently brushing it into the asphalt. Asphalt is then applied to the seams between the strips of the fiber glass fabric, and coating material of the type of Example I is then sprayed onto the intermediate fiber glass fabric layer in an amount of approximately 4 to 5 gallons per 100 sq. feet, with the coating material passing through the fiber glass fabric to bond with the asphalt underlayer and embed the fiber glass fabric therebetween with the coating material covering the fiber glass fabric. The first overlayer is allowed to dry, which may take only 3 hours in warm, dry weather, may take over night in normal circumstances, and may take as much as 30 days in cold humid weather. A second coat of the coating material of Example I is then applied to the first overlayer to form a second overlayer bonded to the first overlayer and, thereby, complete the coating system.

EXAMPLE V

The procedure of Example IV is followed using the coating material of Example II for a humid climate where mildew resistance is important. This requires a longer drying period than the minimum drying period possible with Example IV.

EXAMPLE VI

The procedure of Example IV is followed using the coating material of Example III for use in cooler, drier weather with a longer drying time than the minimum drying time allowable with the coating material used in Example IV.

The foregoing detailed description and examples are provided for illustrative purposes only and are not intended to be limiting as to the scope of the present invention. Various modifications and variations are contemplated within the scope of the present invention, which is intended to be limited only by the scope of the accompanying claims.

I claim:

1. A coating system of high tensile strength and resilience for use as a coating for roofs, swimming pools and the like comprising an underlayer of asphalt material, an intermediate layer of woven fiber glass fabric, a first overlayer of coating material bonded to said underlayer and intermediate layer with said intermediate fiber glass fabric layer embedded between said underlayer and said first overlayer, and a second overlayer of said coating material bonded to said first overlayer, said woven fiber glass fabric including strands of bulked yarn in a relatively loose weave, and said coating material comprising an acrylic resin emulsion.

2. A coating system according to claim 1 and characterized further in that said intermediate layer of woven fiber glass fabric comprises said strands of bulked yarn as the filling ends of said fabric and strands of non-bulked yarn as the warp ends of said fabric.

3. A coating system according to either claim 1 or claim 2 and characterized further in that said woven fiber glass fabric has a weight of approximately 4 ounces per square inch.

4. A coating system according to either claim 1 or claim 2 and characterized further in that said woven fiber glass fabric comprises approximately 18 warp ends per inch and approximately 15 filling ends per inch.

5. A coating system according to either claim 1 or claim 2 and characterized further in that said woven fiber glass fabric comprises filling ends of 150 denier single yarn with a twist of approximately 0.7 turns per inch and warp ends of 150 denier single yarn with a twist of approximately 0.7 turns per inch.

6. A coating system according to claim 1 and characterized further in that said coating material comprises water, a high solids thermoplastic acrylic emulsion, calcium carbonate, titanium dioxide, sodium salt of polymeric carboxylic acid, a wetting, emulsifying and stabilizing agent and defoamers.

7. A coating system according to claim 1 and characterized further in that said coating material comprises in approximate percentages by weight:

| | |
|---|---|
| Water | 36% |
| High solids thermoplastic acrylic emulsion | 29% |
| Calcium carbonate | 31% |
| Titanium dioxide | 3% |
| Sodium salt of polymeric carboxylic acid | 0.3% |
| Wetting, emulsifying and stabilizing agent | 0.1% |
| Defoamers | 0.5% |

8. A coating system according to either claim 6 or claim 7 and characterized further in that said wetting, emulsifying and stabilizing agent is octyl phenol polyethoxy ethanol.

9. A coating system according to claim 1 and characterized further in that said coating material comprises the following components in the relative approximate quantities indicated:

| | |
|---|---|
| Water | 70 Gallons |
| High solids thermoplastic acrylic emulsion | 55 Gallons |
| Calcium carbonate | 500 Pounds |
| Titanium dioxide | 50 Pounds |
| Sodium salt of polymeric carboxylic acid | 4.8 Pounds |
| Octyl phenol polyethoxy ethanol | 1.4 Pounds |

-continued

| | |
|---|---|
| Defoamers | 1 Gallon |

10. A coating system according to either claim 7 or claim 9 and characterized further in that the water content of said coating material is reduced to approximately 50 gallons.

11. A coating system according to claim 6 and characterized further in that said coating material includes zinc oxide for mildew resistance.

12. A coating system according to claim 9 and characterized further in that said coating material includes zinc oxide in an amount of 25–75 pounds.

* * * * *